US007855631B2

(12) United States Patent
Higuchi et al.

(10) Patent No.: US 7,855,631 B2
(45) Date of Patent: Dec. 21, 2010

(54) COMPOSITE DEVICE

(75) Inventors: Yoshihiro Higuchi, Chichibu-gun (JP); Koji Yotsumoto, Hanno (JP)

(73) Assignee: Mitsubishi Materials Corporation, Tokyo (JP)

( * ) Notice: Subject to any disclaimer, the term of this patent is extended or adjusted under 35 U.S.C. 154(b) by 1069 days.

(21) Appl. No.: 11/569,349

(22) PCT Filed: Mar. 29, 2005

(86) PCT No.: PCT/JP2005/005925

§ 371 (c)(1),
(2), (4) Date: Nov. 17, 2006

(87) PCT Pub. No.: WO2005/112049

PCT Pub. Date: Nov. 24, 2005

(65) Prior Publication Data

US 2007/0229210 A1 Oct. 4, 2007

(30) Foreign Application Priority Data

May 18, 2004 (JP) ..... 2004-147745

(51) Int. Cl.
*H01C 7/10* (2006.01)

(52) U.S. Cl. ..... 338/22 R; 338/13; 338/320; 338/309

(58) Field of Classification Search ..... 338/22 R, 338/13, 258, 260, 320, 309, 313
See application file for complete search history.

(56) References Cited

U.S. PATENT DOCUMENTS 4,276,535 A * 6/1981 Mitsuyu et al. ..... 338/22 R
5,600,296 A * 2/1997 Kuzuoka et al. ..... 338/22 R
5,798,684 A * 8/1998 Endo et al. ..... 338/22 R

FOREIGN PATENT DOCUMENTS

| | | | |
|---|---|---|---|
| JP | 3-23901 | * | 3/1991 |
| JP | 4-4703 | * | 1/1992 |
| JP | 4-4709 | * | 1/1992 |
| JP | 05-029113 | A | 2/1993 |
| JP | 05-029114 | A | 2/1993 |
| JP | 10-294207 | A | 11/1998 |
| JP | 11-064116 | A | 3/1999 |
| JP | 11-067508 | | 3/1999 |

OTHER PUBLICATIONS

Patent Abstracts of Japan for JP10-294207 published Nov. 4, 1998.

* cited by examiner

*Primary Examiner*—Kyung Lee
(74) *Attorney, Agent, or Firm*—Leason Ellis LLP.

(57) ABSTRACT

A first terminal electrode is provided directly on one longitudinal end surface of a chip thermistor element, a third terminal electrode is provided directly on the other end surface, a second terminal electrode is provided on a top surface via an insulating layer, a resistor layer is provided adjacent to the second terminal electrode, the second terminal electrode is electrically connected to the resistor layer, and the resistor is electrically connected to the first terminal electrode. Voltage is applied between the input terminal electrode and the ground terminal electrode, the voltage between the output terminal electrode and the ground terminal electrode is measured, and the output voltage is converted to a temperature to detect a change in the temperature.

11 Claims, 11 Drawing Sheets

COMPOSITE DEVICE

CROSS REFERENCE TO PRIOR APPLICATION

This is a U.S. national phase application under 35 U.S.C. §371 of International Patent Application No. PCT/JP2005/005925 filed Mar. 29, 2005, and claims the benefit of Japanese Application No. 2004-147745, filed May 18, 2004, both of which are incorporated by reference herein. The International Application was published in Japanese on Nov. 24, 2005 as International Publication No. WO2005/112049 A1 under PCT Article 21(2).

TECHNICAL FIELD

The present invention relates to a composite device in which a thermistor and a resistor are connected, and in particular, relates to a composite device effective for temperature measurement, temperature-control circuits, overheat-protection circuits, battery packs, LCDs, HDDs, DVDs (OPUs), motherboards, cooling fans, FETs, IBGTs, ECUs, and so forth.

BACKGROUND ART

One known example of temperature-detection circuits employing thermistors is shown as an equivalent circuit in FIG. 19, where an input terminal electrode 24, a resistor 26, an output terminal electrode 23, a thermistor 22, and a ground terminal electrode 25 are connected in series in that order.

In the temperature-detection circuit with this structure, voltage is applied between the input terminal electrode 24 and the ground terminal electrode 25, and then the voltage between the output terminal electrode 23 and the ground terminal electrode 25 is measured. Thereafter, the output voltage is converted into a temperature to detect a change in the temperature.

In order to reduce the size of the temperature-detection circuit with the above-described structure, it is a typical approach to mount components including the resistor and thermistor on a circuit board.

However, if the size of the temperature-detection circuit is reduced by the above-described approach, manufacturing takes more time, leading to high manufacturing cost. Furthermore, since the above-described approach leads to a large mounting footprint on the circuit board, the size cannot be reduced more than expected.

Furthermore, in order to achieve small size and integration into a single chip, there is proposed a composite device including a chip thermistor element, terminal electrodes formed on both end surfaces of the thermistor element, and a resistor layer formed on a side surface of the thermistor element, wherein one terminal electrode, the resistor layer, the thermistor element, and the other terminal electrode are connected in series in that order (for example, Japanese Unexamined Patent Application, Publication No. H10-294207).

In the composite device with this structure, components including the thermistor element, the terminal electrodes, and the resistor layer can be integrated into a single chip to reduce the total size. Furthermore, the mounting footprint on the circuit board can be made small, thus allowing the total size of the circuit board to be reduced.

However, for the composite device with this structure, a resistor is separately required to achieve a linear characteristic of the thermistor element. Furthermore, it is necessary to select the resistor or add a trimmer in order to achieve matching between the thermistor element and an internal resistor. This leads to high manufacturing cost.

SUMMARY OF THE INVENTION

The present invention has been conceived in light of the above-described known problems, and it is an object of the present invention to provide a composite device that can be made compact easily and manufactured at low cost; that can be made compact as a whole without increasing the mounting footprint on a circuit board; that does not require a separate resistor to achieve a linear characteristic of a thermistor element while still achieving small size and integration into a single chip; and that can be manufactured at low cost without selecting a resistor or adding a trimmer to achieve matching between the thermistor element and an internal resistor.

In order to overcome the above-described problems, the present invention employs the following embodiment. The invention can be characterized by providing: on a surface of a chip thermistor element, a first terminal electrode; a second terminal electrode; a third terminal electrode via an insulating layer; and a resistor layer via an insulating layer, wherein the first terminal electrode and the third terminal electrode are connected to the resistor layer.

The composite device in accordance with the present invention can be effectively used as a temperature-detection circuit, a temperature-compensation circuit, and the like by using the first electrode as an output terminal electrode, the second terminal electrode as a ground terminal electrode, and the third terminal electrode as an input terminal electrode and then by applying a voltage between the input terminal electrode and the ground terminal electrode and measuring the voltage between the output terminal electrode and the ground terminal electrode. This allows the size of the entire circuit to be reduced.

An embodiment of the invention can be characterized by providing, on a surface of a chip thermistor element, a first terminal electrode; a second terminal electrode; a third terminal electrode; and a resistor layer via an insulating layer, wherein the first terminal electrode and the third terminal electrode are connected to the resistor layer.

The composite device in accordance with the present invention can be effectively used as a temperature-detection circuit, a temperature-compensation circuit, and the like. by using the first electrode as an output terminal electrode, the second terminal electrode as a ground terminal electrode, and the third terminal electrode as an input terminal electrode and then by applying a voltage between the input terminal electrode and the ground terminal electrode and measuring the voltage between the output terminal electrode and the ground terminal electrode. This allows the size of the entire circuit to be reduced.

Another embodiment related to the above two embodiments, wherein one of the first terminal electrode, the second terminal electrode, and the third terminal electrode serves as an internal electrode for adjusting a resistance of the thermistor element.

In accordance with the composite device of the present invention, the resistance of the thermistor element is adjusted by one of the first terminal electrode, the second terminal electrode, and the third terminal electrode.

A further embodiment related to the above, wherein an internal electrode for adjusting a resistance of the thermistor element is connected to one of or between at least two or more of the first terminal electrode, the second terminal electrode, the third terminal electrode, and the resistor layer.

In accordance with the composite device of the present invention, the resistance of the thermistor element is adjusted by the internal electrode provided at one of or between at least two or more of the first terminal electrode, the second terminal electrode, the third terminal electrode, and the resistor layer.

An embodiment of the invention is characterized by providing, on a surface of a chip thermistor element, a first terminal electrode; a second terminal electrode; a third terminal electrode via an insulating layer; and a first resistor layer and a second resistor layer via an insulating layer, wherein the first terminal electrode and the third terminal electrode are connected to the first resistor layer, and one end of the second resistor layer is connected to the first terminal electrode and the other end is connected to the second terminal electrode such that the second resistor layer is connected in parallel to the thermistor element.

The composite device in accordance with the present invention can be effectively used as a temperature-detection circuit, a temperature-compensation circuit, and the like by using the first electrode as an output terminal electrode, the second terminal electrode as a ground terminal electrode, and the third terminal electrode as an input terminal electrode and then by applying a voltage between the input terminal electrode and the ground terminal electrode and measuring the voltage between the output terminal electrode and the ground terminal electrode. This allows the size of the entire circuit to be reduced.

A further embodiment of the invention can be is characterized by providing, on a surface of a chip thermistor element, a first terminal electrode; a second terminal electrode and a third terminal electrode via an insulating layer; and a first resistor layer, a second resistor layer, and a third resistor layer via an insulating layer, wherein the first terminal electrode and the third terminal electrode are connected to the first resistor layer, and wherein one end of the first resistor layer is connected to the first terminal electrode and the third resistor layer is connected between the other end of the second resistor layer and the second terminal electrode such that the second resistor layer is connected in parallel to the thermistor element.

The composite device in accordance with the present invention can be effectively used as a temperature-detection circuit, a temperature-compensation circuit, and the like by using the first electrode as an output terminal electrode, the second terminal electrode as a ground terminal electrode, and the third terminal electrode as an input terminal electrode and then by applying a voltage between the input terminal electrode and the ground terminal electrode and measuring the voltage between the output terminal electrode and the ground terminal electrode. This allows the size of the entire circuit to be reduced.

The invention can be embodied by providing, on a surface of a chip thermistor element, a first terminal electrode; a second terminal electrode; a third terminal electrode via an insulating layer; and a first resistor layer and a second resistor layer via an insulating layer, wherein one end of the first resistor layer is connected to the third terminal electrode, the other end is connected to the thermistor element via an internal electrode, and one end of the second resistor layer is connected to the first resistor layer via the internal electrode and the other end is connected to the first terminal electrode such that the second resistor layer is connected in parallel to the thermistor element.

The composite device in accordance with the present invention can be effectively used as a temperature-detection circuit, a temperature-compensation circuit, and the like by using the first electrode as an output terminal electrode, the second terminal electrode as a ground terminal electrode, and the third terminal electrode as an input terminal electrode and then by applying a voltage between the input terminal electrode and the ground terminal electrode and measuring the voltage between the output terminal electrode and the ground terminal electrode. This allows the size of the entire circuit to be reduced.

Another embodiment can be characterized in that an insulating layer is provided on a surface, except the first to third terminal electrodes, of a device main body portion of the composite device, and one or more terminal electrodes which are formed on a side surface of the main body portion and are selected from among the first to third terminal electrodes, are provided on at least one or more side surfaces of the main body portion of the composite device.

Since the composite device in accordance with the present invention includes an insulating layer on a surface of the main body portion thereof, the surface layer of the composite device, which contributes to degradation in reliability under harsh environments, can be protected to increase reliability levels, such as heat resistance, cold resistance, moisture resistance, and so forth. Furthermore, since the terminal electrode formed on a side surface of the main body portion of the composite device is provided on at least one or more side surfaces of the main body portion of the composite device, a superior solder joint (fillet) is formed between a mounting board (land portion) and the terminal electrode of the composite device during soldering. This achieves high-reliability mounting.

A further embodiment of the invention is characterized by further including a fourth junction terminal in addition to the first to third terminal electrodes, the fourth junction terminal being electrically insulated from the first to third terminal electrodes and being used to fix the composite device, wherein the fourth terminal electrode is provided on at least one or more side surfaces of the main body portion of the composite device.

In accordance with the composite device of the present invention, since the junction terminal used to fix the composite device is additionally provided on a surface of the chip thermistor element, the composite device can be more firmly mounted on a board of, for example, an electronic device. Consequently, the strength with which the composite device is mounted on the board can be increased.

As described above, the composite device of the present invention can be effectively used, for example, as a temperature-detection circuit by using the first electrode as an output terminal electrode, the second terminal electrode as a ground terminal electrode, and the third terminal electrode as an input terminal electrode and then by applying a voltage between the input terminal electrode and the ground terminal electrode and measuring the voltage between the output terminal electrode and the ground terminal electrode. This allows the size of the entire circuit to be reduced and the entire circuit to be integrated into a single chip. Therefore, when the composite device is to be used for a temperature-detection circuit for example, the mounting footprint on a circuit board can be made small, thus allowing the size of the circuit board to be reduced. Furthermore, a separate resistor is not required to achieve a linear characteristic of the thermistor element. Furthermore, since it is not necessary to select a resistor layer or add a trimmer to the resistor layer in order to establish matching between the thermistor element and an internal resistor layer, the manufacturing cost can be reduced significantly.

DETAILED DESCRIPTION THE INVENTION

Figure 1:
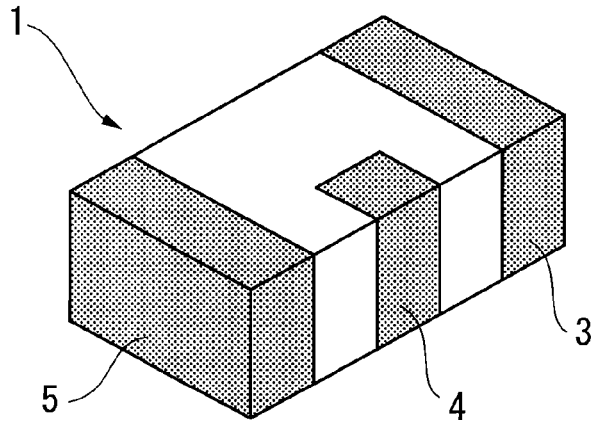
FIG. 1 is an entire perspective view of a composite device in accordance with an embodiment of the present invention.

Embodiments in accordance with the present invention shown in the drawings will now be described.

Figure 2:
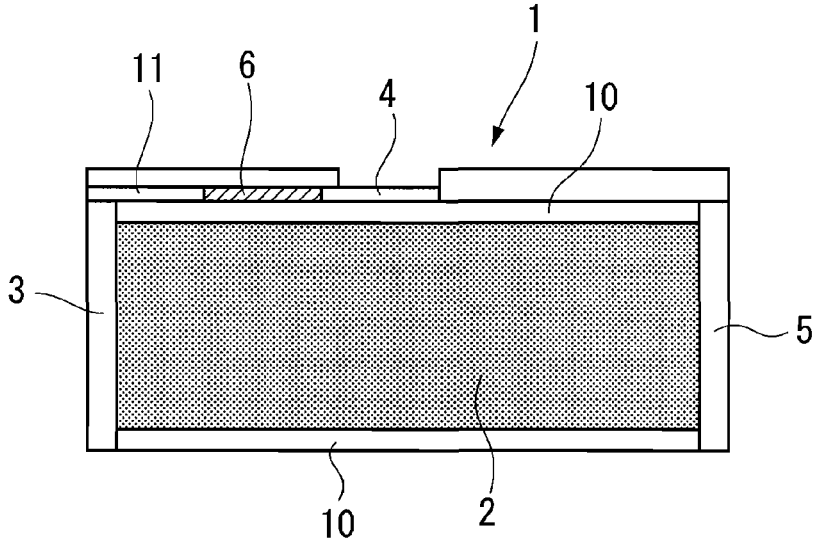
FIG. 2 is a cross-sectional view of FIG. 1.
Figure 3:
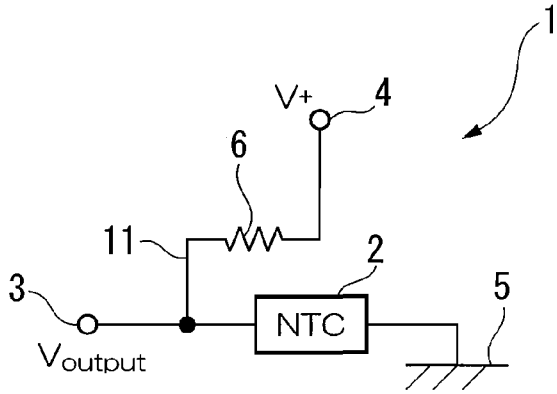
FIG. 3 is an equivalent circuit diagram of the composite device shown in FIGS. 1 and 2.

FIGS. 1 to 3 show a composite device in accordance with an embodiment of the present invention. FIG. 1 is a perspective view of the entire composite device, FIG. 2 is a cross-sectional view of FIG. 1, and FIG. 3 is an equivalent circuit diagram of the composite device shown in FIGS. 1 and 2.

More specifically, this composite device 1 includes a chip thermistor element 2; a first terminal electrode 3 and a second terminal electrode 5 provided directly on the surface of the thermistor element 2; a third terminal electrode 4 provided on the surface of the thermistor element 2 via an insulating layer 10; and a resistor layer 6 provided on the surface of the thermistor element 2 via the insulating layer 10.

In this embodiment and the embodiments described later, among the electrodes provided on the surface of the thermistor element, an electrode for receiving an input or providing an output is referred to as a "terminal electrode," and other electrodes are referred to as "internal electrodes" for adjusting the resistance of the thermistor element.

Examples of the thermistor element 2 include NTC type thermistors, PTC type thermistors, and CTR type thermistors, and an NTC type thermistor is used in this embodiment. The thermistor element 2 is formed of, for example, an Mn—Co—Cu-based or Mn—Co—Fe-based material. The shape of the thermistor element 2 is not particularly limited. The thermistor element 2 is shaped like a rectangular solid in this embodiment.

The output terminal electrode 3, which is the first terminal electrode, is integrally formed on one longitudinal end surface of the thermistor element 2. The ground terminal electrode 5, which is the second terminal electrode, is integrally formed on the other longitudinal end surface. The input terminal electrode 4, which is the third terminal electrode, is integrally formed on the top surface via the insulating layer 10 which is to be described later.

The output terminal electrode 3 and the ground terminal electrode 5 are integrally formed on one end surface and the other end surface, respectively, in the longitudinal direction of the thermistor element 2 by, for example, screen-printing a conductive electrode paste on the one end surface and the other end surface in the longitudinal direction and then baking it after being dried. The input terminal electrode 4 is integrally formed so as to have a predetermined thickness on the top surface of the thermistor element 2 via the insulating layer 10 by, for example, screen-printing a conductive electrode paste on the surface of the insulating layer 10 and then baking it after being dried.

Insulating layers 10 are provided on the top surface and the bottom surface thereof respectively. These insulating layers 10 are integrally formed on the top surface and the bottom surface, respectively, of the thermistor element 2 by, for example, screen-printing a glass paste on each of the top and the bottom surfaces of the thermistor element 2 and then baking it after being dried.

The above-described input terminal electrode 4 is integrally formed at the center portion on the insulating layer 10 of the top surface of the thermistor element 2. The resistor layer 6 is integrally provided, when viewed in the figure, to the left of the input terminal electrode 4. An internal electrode 11 is integrally provided, when viewed in the figure, to the left of the resistor layer 6. In this case, an electrical connection is made between the resistor layer 6 and the input terminal electrode 4. Baking of the above-described input terminal electrode 4 and baking of the insulating layer 10 may be performed together.

The resistor layer 6 is integrally formed on the surface of the insulating layer 10 by, for example, screen-printing an $RuO_2$-based resistor paste on the surface of the insulating layer 10 and then baking it after being dried. Baking of the resistor layer 6 and baking of the insulating layer 10 may be performed together.

Like the input terminal electrode 4, the internal electrode 11 is integrally formed on the surface of the insulating layer 10 by, for example, screen-printing a conductive electrode paste on the surface of the insulating layer 10 and then baking it after being dried. In this case, an electrical connection is made between the internal electrode 11 and the resistor layer 6, as well as between the internal electrode 11 and the output terminal electrode 3. As with the input terminal electrode 4, the baking of the internal electrode 11 may be performed together with the baking of the insulating layer 10.

As described above, by providing the output terminal electrode 3 and the ground terminal electrode 5 directly on the surface of the thermistor element 2, providing the input terminal electrode 4 on the surface of the thermistor element 2 via the insulating layer 10, providing the resistor layer 6 on the surface of the thermistor element 2 via the insulating layer 10, establishing an electrical connection between the resistor layer 6 and the input terminal electrode 4, and establishing an electrical connection between the resistor layer 6 and the output terminal electrode 3 via the internal electrode 11, the composite device 1 in which the input terminal electrode 4, the resistor layer 6, the internal electrode 11, the output terminal electrode 3, the thermistor element 2, and the ground terminal electrode 5 are connected in series in that order is obtained, as shown by the equivalent circuit in FIG. 3.

Thereafter, the composite device 1 obtained as described above is mounted on the surface of a circuit board (not shown in the figure), a voltage is applied between the input terminal electrode 4 and the ground terminal electrode 5, and then the voltage between the output terminal electrode 3 and the ground terminal electrode 5 is measured. Then, temperature can be detected by converting the output voltage into a temperature value.

The composite device 1 in accordance with this embodiment with the above-described structure is integrated into a single chip in which the output terminal electrode 3 and the ground terminal electrode 5 are provided directly on the surface of the thermistor element 2; the input terminal electrode 4 is provided on the surface of the thermistor element 2 via the insulating layer 10; the resistor layer 6 is provided on the surface of the thermistor element 2 via the insulating layer 10; an electrical connection is made between the resistor layer 6 and the input terminal electrode 4; and an electrical connection is made between the resistor layer 6 and the output terminal electrode 3 via the internal electrode 11. As a result, the overall size can be reduced. Therefore, when the composite device 1 is to be used for a temperature-detection circuit for example, the mounting footprint on the circuit board can be made small, thus allowing the size of the circuit board to be reduced.

Furthermore, a separate resistor is not required to achieve a linear characteristic of the thermistor element 2. Furthermore, it is not necessary to select the resistor layer 6 or add a trimmer to the resistor layer 6 in order to establish matching between the thermistor element 2 and the internal resistor layer 6. Therefore, the manufacturing cost can be reduced significantly.

Figure 4:
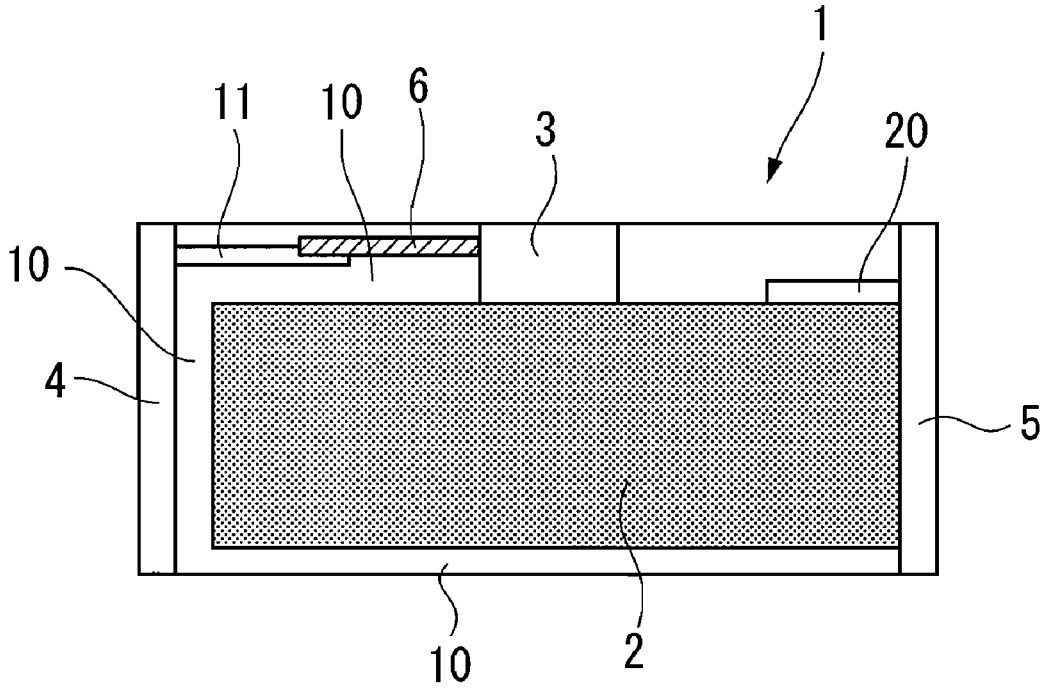
FIG. 4 is a cross-sectional view of a composite device in accordance with another embodiment of the present invention.
Figure 5:
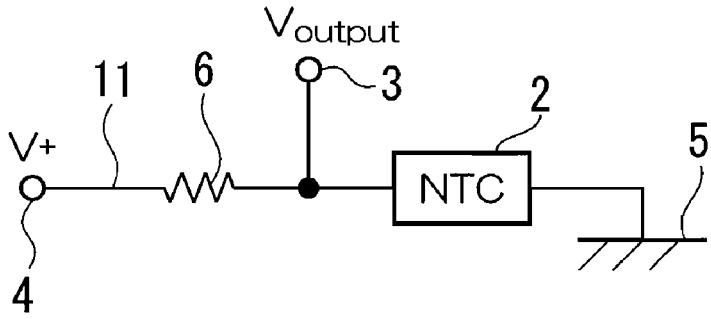
FIG. 5 is an equivalent circuit diagram of the composite device shown in FIG. 4.

FIGS. 4 and 5 show a composite device in accordance with another embodiment of the present invention. In this composite device 1, an input terminal electrode 4 is provided on one longitudinal end surface of a thermistor element 2 via an insulating layer 10; a ground terminal electrode 5 is provided directly on the other end surface; an output terminal electrode 3 is provided at a center portion directly on the top surface of the thermistor element 2; a resistor layer 6 is provided, when viewed in the figure, to the left of the output terminal electrode 3 on the top surface of the thermistor element 2 via the insulating layer 10; an internal electrode 11 is provided, when viewed in the figure, to the left of the resistor layer 6; an electrical connection is established between the resistor layer 6 and the output terminal electrode 3; and an electrical connection is established between the resistor layer 6 and the input terminal electrode 4 via the internal electrode 11. The other structures are the same as those shown in the above-described first embodiment. Reference numeral 20 in the figure denotes an internal electrode for adjusting the resistance of the thermistor element 2.

In this case, as shown by the equivalent circuit of FIG. 5, the composite device 1 including a circuit in which the input terminal electrode 4, the internal electrode 11, the resistor layer 6, the output terminal electrode 3, the thermistor element 2, and the ground terminal electrode 5 are connected in series in that order is obtained.

Also, the composite device 1 in accordance with this embodiment is integrated into a single chip in which the output terminal electrode 3 and the ground terminal electrode 5 are provided directly on the surface of the thermistor element 2; the input terminal electrode 4 is provided on the surface of the thermistor element 2 via the insulating layer 10; the resistor layer 6 is provided on the surface of the thermistor element 2 via the insulating layer 10; an electrical connection is made between the resistor layer 6 and the output terminal electrode 3; and an electrical connection is made between the resistor layer 6 and the input terminal electrode 4 via the internal electrode 11. As a result, the overall size can be reduced. Therefore, when the composite device 1 is to be used for a temperature-detection circuit for example, the mounting footprint on the circuit board can be made small, thus allowing the size of the circuit board to be reduced.

Furthermore, a separate resistor is not required to achieve a linear characteristic of the thermistor element 2. Furthermore, it is not necessary to select the resistor layer 6 or add a trimmer to the resistor layer 6 in order to establish matching between the thermistor element 2 and the internal resistor layer 6. Therefore, the manufacturing cost can be reduced significantly.

Figure 6:
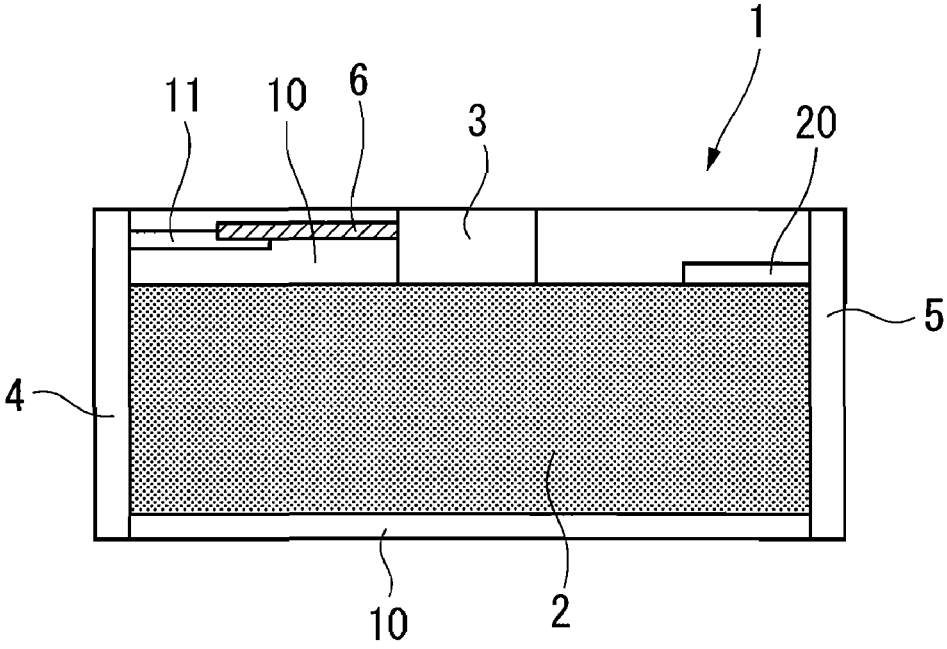
FIG. 6 is a cross-sectional view of a composite device in accordance with a further embodiment of the present invention.
Figure 7:
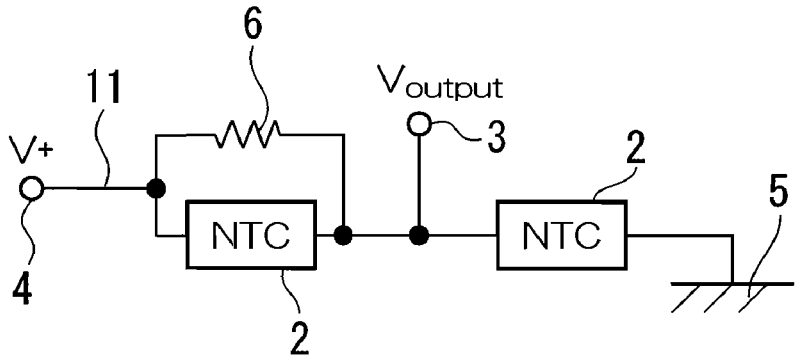
FIG. 7 is an equivalent circuit diagram of the composite device shown in FIG. 6.

FIGS. 6 and 7 show a composite device in accordance with a further embodiment of the present invention. In this composite device 1, an input terminal electrode 4 is provided directly on one longitudinal end surface of a thermistor element 2; a ground terminal electrode 5 is provided directly on the other end surface; an output terminal electrode 3 is provided at a center portion directly on the top surface; a resistor layer 6 is provided, when viewed in the figure, to the left of the output terminal electrode 3 on the top surface via an insulating layer 10; an internal electrode 11 is provided, when viewed in the figure, to the left of the resistor 6 layer; the resistor layer 6 is electrically connected to the output terminal electrode 3; and an electrical connection is established between the resistor layer 6 and the input terminal electrode 4 via the internal electrode 11. The other structures are the same as those shown in the above-described embodiments. Reference numeral 20 in the figure denotes an internal electrode for adjusting the resistance of the thermistor element 2.

In this case, as shown by the equivalent circuit of FIG. 7, the composite device 1 including a circuit in which the input terminal electrode 4, the internal electrode 11, the resistor layer 6, the output terminal electrode 3, the thermistor element 2, and the ground terminal electrode 5 are connected in series in that order and in which the thermistor element 2 is connected between the input terminal electrode 4 and the output terminal electrode 3 in parallel to the resistor layer 6 is obtained.

Also, the composite device 1 in accordance with this embodiment is integrated into a single chip in which the input terminal electrode 4, the output terminal electrode 3, and the ground terminal electrode 5 are provided directly on the surface of the thermistor element 2; the resistor layer 6 is provided on the surface of the thermistor element 2 via the insulating layer 10; the resistor layer 6 is electrically connected to the output terminal electrode 3; and an electrical connection is made between the resistor layer 6 and the input terminal electrode 4 via the internal electrode 11. As a result, the overall size can be reduced. Therefore, when the composite device 1 is to be used for a temperature-detection circuit for example, the mounting footprint on the circuit board can be made small, thus allowing the size of the circuit board to be reduced.

Furthermore, a separate resistor is not required to achieve a linear characteristic of the thermistor element 2. Furthermore, it is not necessary to select the resistor layer 6 or add a trimmer to the resistor layer 6 in order to establish matching between the thermistor element 2 and the internal resistor layer 6. Therefore, the manufacturing cost can be reduced significantly.

Furthermore, since a circuit that uses two thermistor elements 2, 2 in a pseudo manner is constructed, the relationship between the output voltage and the temperature can be made more linear to achieve more accurate temperature detection.

Figure 8:
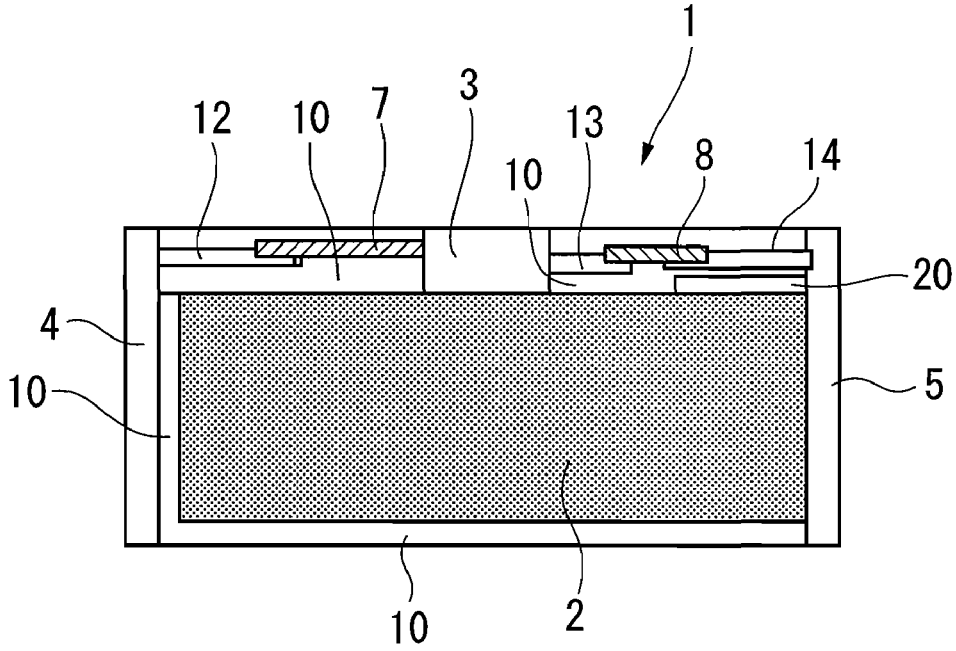
FIG. 8 is a cross-sectional view of a composite device in accordance with an embodiment of the present invention.
Figure 9:
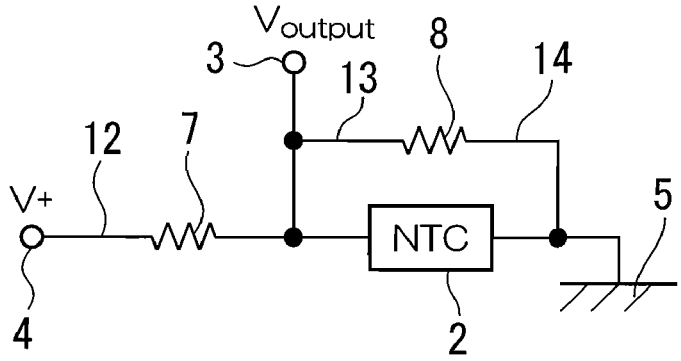
FIG. 9 is an equivalent circuit diagram of the composite device shown in FIG. 8.

FIGS. 8 and 9 show a composite device in accordance with an embodiment of the present invention. In this composite device 1, an input terminal electrode 4 is provided on one longitudinal end surface of a thermistor element 2 via an insulating layer 10; a ground terminal electrode 5 is provided directly on the other end surface; an output terminal electrode 3 is provided at a center portion directly on the top surface; a first resistor layer 7 is provided, when viewed in the figure, to the left of the output terminal electrode 3 via the insulating layer 10; a second resistor layer 8 is provided, when viewed in the figure, to the right of the output terminal electrode 3 via the insulating layer 10; a first internal electrode 12 is provided, when viewed in the figure, to the left of the first resistor layer 7; a second internal electrode 13 and a third internal electrode 14 are provided, when viewed in the figure, to the left and the right, respectively, of the second resistor layer 8; an electrical connection is established between the first resistor layer 7 and the output terminal electrode 3; an electrical connection is established between the first resistor layer 7 and the input terminal electrode 4 via the first internal electrode 12; an electrical connection is established between the second resistor layer 8 and the output terminal electrode 3 via the second internal electrode 13; and an electrical connection is established between the second resistor layer 8 and the ground terminal electrode 5 via the third internal electrode 14. The other structures are the same as those shown in the above-described embodiments. Reference numeral 20 in the figure denotes an internal electrode for adjusting the resistance of the thermistor element 2.

In this case, as shown by the equivalent circuit of FIG. 9, the composite device 1 including a circuit in which the input terminal electrode 4, the first internal electrode 12, the first resistor layer 7, the output terminal electrode 3, the thermistor element 2, and the ground terminal electrode 5 are connected in series and in which the second resistor layer 8 is connected between the output terminal electrode 3 and the ground terminal electrode 5 in parallel to the thermistor element 2 via the second internal electrode 13 and the third internal electrode 14 is obtained.

Also, the composite device 1 in accordance with this embodiment is integrated into a single chip in which the input terminal electrode 4 is provided on the surface of the thermistor element 2 via the insulating layer 10; the output terminal electrode 3 and the ground terminal electrode 5 are provided directly on the surface of the thermistor element 2; the first resistor layer 7 and the second resistor layer 8 are provided on the surface of the thermistor element 2 via the insulating layer 10; an electrical connection is established between the first resistor layer 7 and the output terminal electrode 3; an electrical connection is established between the first resistor layer 7 and the input terminal electrode 4 via the first internal terminal electrode 12; an electrical connection is established between the second resistor layer 8 and the output terminal electrode 3 via the second internal electrode 13; and an electrical connection is established between the second resistor layer 8 and the ground terminal electrode 5 via the third internal electrode 14. As a result, the overall size can be reduced. Therefore, when the composite device 1 is to be used for a temperature-detection circuit for example, the mounting footprint on the circuit board can be made small, thus allowing the size of the circuit board to be reduced.

Furthermore, a separate resistor is not required to achieve a linear characteristic of the thermistor element 2. Furthermore, it is not necessary to select the resistor layers 7 and 8 or add trimmers to the resistor layers 7 and 8 in order to establish matching between the thermistor element 2 and the internal resistor layers 7 and 8. Therefore, the manufacturing cost can be reduced significantly.

Figure 10:
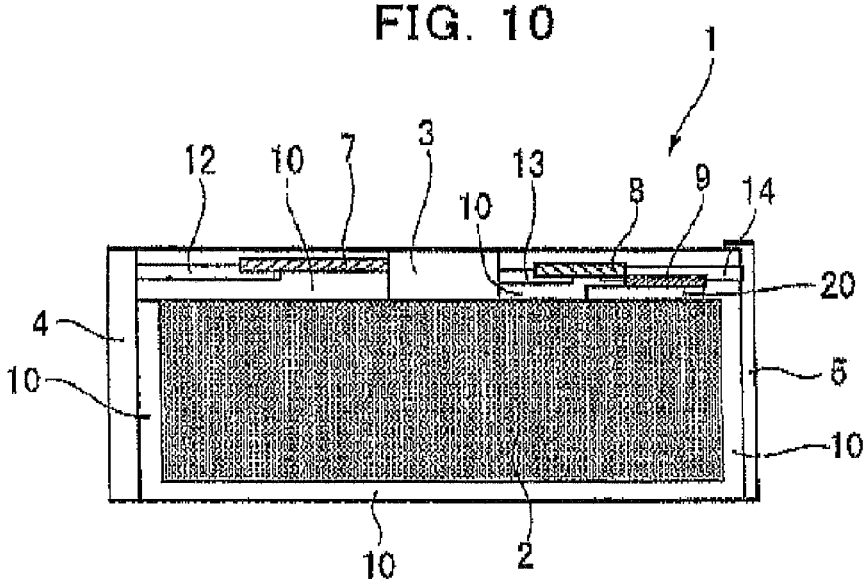
FIG. 10 is a cross-sectional view of a composite device in accordance with another embodiment of the present invention.
Figure 11:
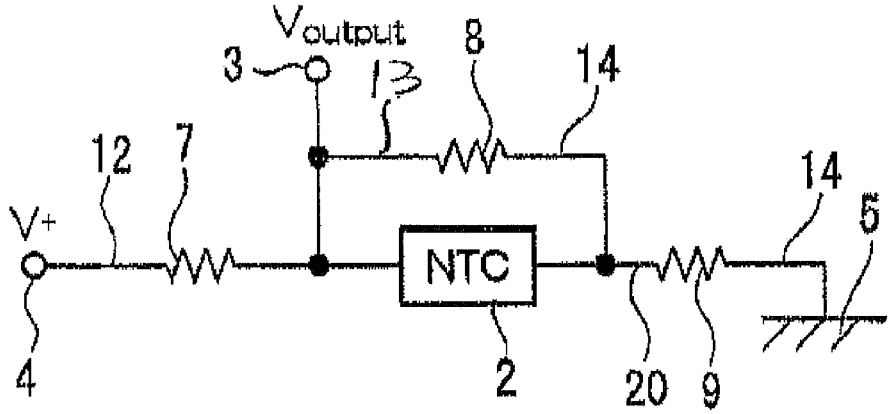
FIG. 11 is an equivalent circuit diagram of the composite device shown in FIG. 10.

FIGS. 10 and 11 show a composite device in accordance with a fifth embodiment of the present invention. In this composite device 1, an input terminal electrode 4 is provided on one longitudinal end surface of a thermistor element 2 via an insulating layer 10; a ground terminal electrode 5 is provided on the other end surface via the insulating layer 10; an output terminal electrode 3 is provided at a center portion directly on the top surface; a first resistor layer 7 is provided, when viewed in the figure, to the left of the output terminal electrode 3 via the insulating layer 10; a second resistor layer 8 is provided, when viewed in the figure, to the right of the output terminal electrode 3 via the insulating layer 10; a third resistor layer 9 is provided, when viewed in the figure, to the right of the second resistor layer 8 via an internal electrode 20 for adjusting the resistance of thermistor element 2; an electrical connection is established between the first resistor layer 7 and the output terminal electrode 3; an electrical connection is established between the first resistor layer 7 and the input terminal electrode 4 via a first internal electrode 12; an electrical connection is established between the second resistor layer 8 and the output terminal electrode 3 via a second internal electrode 13; and an electrical connection is established between the second resistor layer 8 and the ground terminal electrode 5 via a third internal electrode 14. The other structures are the same as those shown in the above-described embodiments.

In this case, as shown by the equivalent circuit of FIG. 11, the composite device 1 including a circuit in which the input terminal electrode 4, the first internal electrode 12, the first resistor layer 7, the output terminal electrode 3, the thermistor element 2, the internal electrode 20, the third resistor layer 9, the third internal electrode 14, and the ground terminal electrode 5 are connected in series and in which the second resistor layer 8 is connected between the output terminal electrode 3 and the ground terminal electrode 5 in parallel to the thermistor element 2 via the second internal electrode 13 and the third internal electrode 14 is obtained.

Also, the composite device 1 in accordance with this embodiment is integrated into a single chip in which the input terminal electrode 4 and the ground terminal electrode 5 are provided on the surface of the thermistor element 2 via the insulating layer 10; the output terminal electrode 3 is provided directly on the surface of the thermistor element 2; the first resistor layer 7 and the second resistor layer 8 are provided on the surface of the thermistor element 2 via the insulating layer 10; the third resistor layer 9 is provided on the surface of the thermistor element 2 via the internal electrode 20; an electrical connection is established between the first resistor layer 7 and the output terminal electrode 3; an electrical connection is established between the first resistor layer 7 and the input terminal electrode 4 via the first internal terminal electrode 12; an electrical connection is established between the second resistor layer 8 and the output terminal electrode 3 via the second internal electrode 13; and an electrical connection is established between the second resistor layer 8 and the ground terminal electrode 8 via the third internal electrode 14. As a result, the overall size can be reduced. Therefore, when the composite device 1 is to be used for a temperature-detection circuit for example, the mounting footprint on the circuit board can be made small, thus allowing the size of the circuit board to be reduced.

Furthermore, a separate resistor is not required to achieve a linear characteristic of the thermistor element 2. Furthermore, it is not necessary to select the resistor layers 7 and 8 or add trimmers to the resistor layers 7 and 8 in order to establish matching between the thermistor element 2 and the internal resistor layers 7 and 8. Therefore, the manufacturing cost can be reduced significantly.

Figure 12:
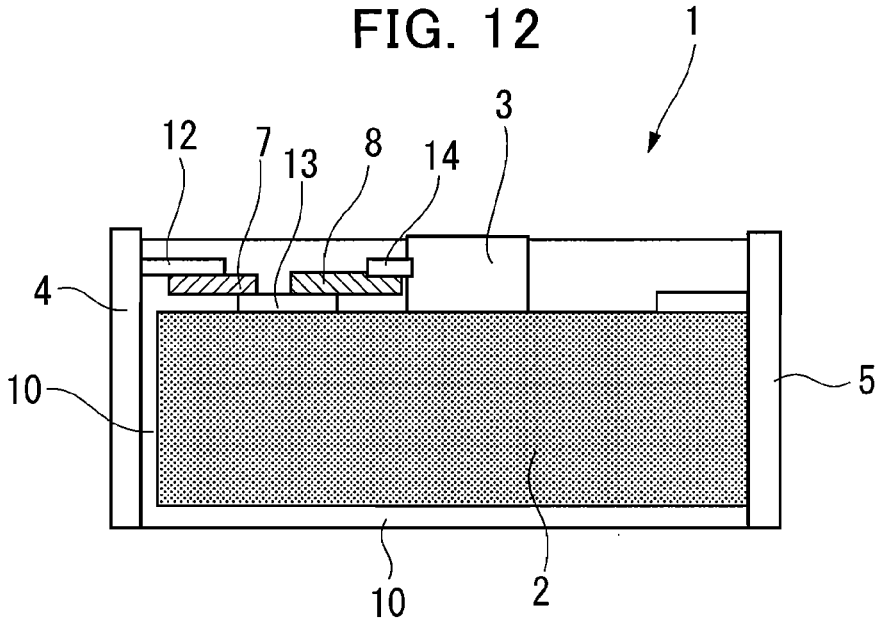
FIG. 12 is a cross-sectional view of a composite device in accordance with a further embodiment of the present invention.
Figure 13:
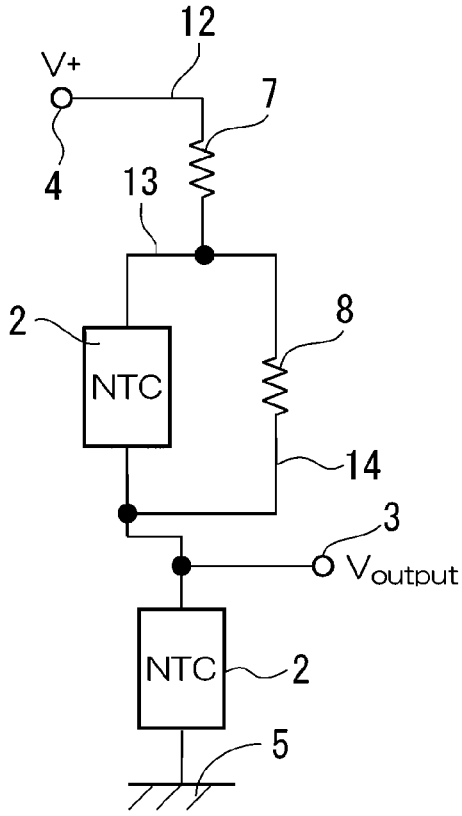
FIG. 13 is an equivalent circuit diagram of the composite device shown in FIG. 12.

FIGS. 12 and 13 show a composite device in accordance with a further embodiment of the present invention. In this composite device 1, an input terminal electrode 4 is provided on one longitudinal end surface of a thermistor element 2 via an insulating layer 10; a ground terminal electrode 5 is provided directly on the other end surface; an output terminal electrode 3 is provided at a center portion directly on the top surface; a first resistor layer 7 and a second resistor layer 8 are provided, when viewed in the figure, to the left of the output terminal electrode 3 via the insulating layer 10; a connection is made between the first resistor layer 7 and the input terminal electrode 4 via a first internal electrode 12; a connection is made between the first resistor layer 7 and the second resistor layer 8 via a second internal electrode 13; the second internal electrode 13 is connected to the thermistor element 2; and the second resistor layer 8 is connected to the output terminal electrode 3 via a third internal electrode 14. The other structures are the same as those shown in the above-described embodiments.

In this case, as shown by the equivalent circuit of FIG. 13, the composite device 1 including a circuit in which the input terminal electrode 4, the first internal electrode 12, the first resistor layer 7, the second internal electrode 13, the thermistor element 2, the output terminal electrode 3, the thermistor element 2, and the ground terminal electrode 5 are connected in series and in which the second resistor layer 8 is connected between the input terminal electrode 4 and the output terminal electrode 3 in parallel to the thermistor element 2 via the second internal electrode 13 and the third internal electrode 14 is obtained.

Also, the composite device 1 in accordance with this embodiment is integrated into a single chip in which the input terminal electrode 4 is provided on the surface of the thermistor element 2 via the insulating layer 10; the output terminal electrode 3 and the ground terminal electrode 5 are provided directly on the surface of the thermistor element 2; the first resistor layer 7 and the second resistor layer 8 are provided on the surface of the thermistor element 2 via the insulating layer 10; an electrical connection is established between the first resistor layer 7 and the input terminal electrode 4 via the first internal terminal electrode 12; a connection is made between the first resistor layer 7 and the second resistor layer 8 via the second internal electrode 13; the second internal electrode 13 is connected to the thermistor element 2; and the second resistor layer 8 is connected to the output terminal electrode 3 via the third internal electrode 14. As a result, the overall size can be reduced. Therefore, when the composite device 1 is to be used for a temperature-detection circuit for example, the mounting footprint on the circuit board can be made small, thus allowing the size of the circuit board to be reduced.

Furthermore, a separate resistor is not required to achieve a linear characteristic of the thermistor element 2. Furthermore, it is not necessary to select the resistor layers 7 and 8 or add trimmers to the resistor layers 7 and 8 in order to establish matching between the thermistor element 2 and the internal resistor layers 7 and 8. Therefore, the manufacturing cost can be reduced significantly.

Furthermore, since a circuit that uses two thermistor elements 2, 2 in a pseudo manner is constructed, the relationship between the output voltage and the temperature can be made more linear to achieve more accurate temperature detection.

Figure 14:
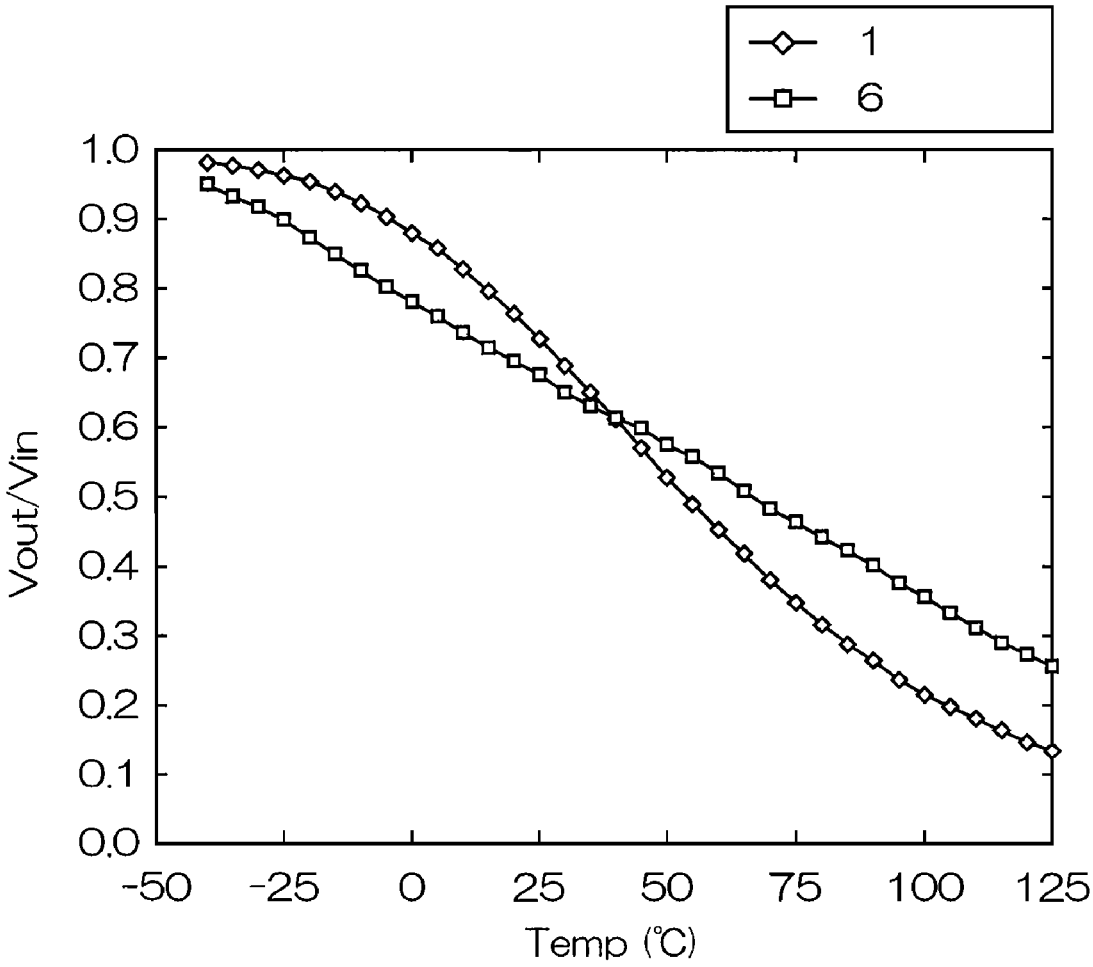
FIG. 14 is a graph showing a characteristic of a composite device in accordance with the present invention.

FIG. 14 shows characteristics of the composite device in accordance with the first described embodiment (1) and the composite device in accordance with the sixth described embodiment (6) of the present invention. From this figure, the composite device in accordance with the sixth described embodiment apparently exhibits a more linear characteristic.

Figure 15:
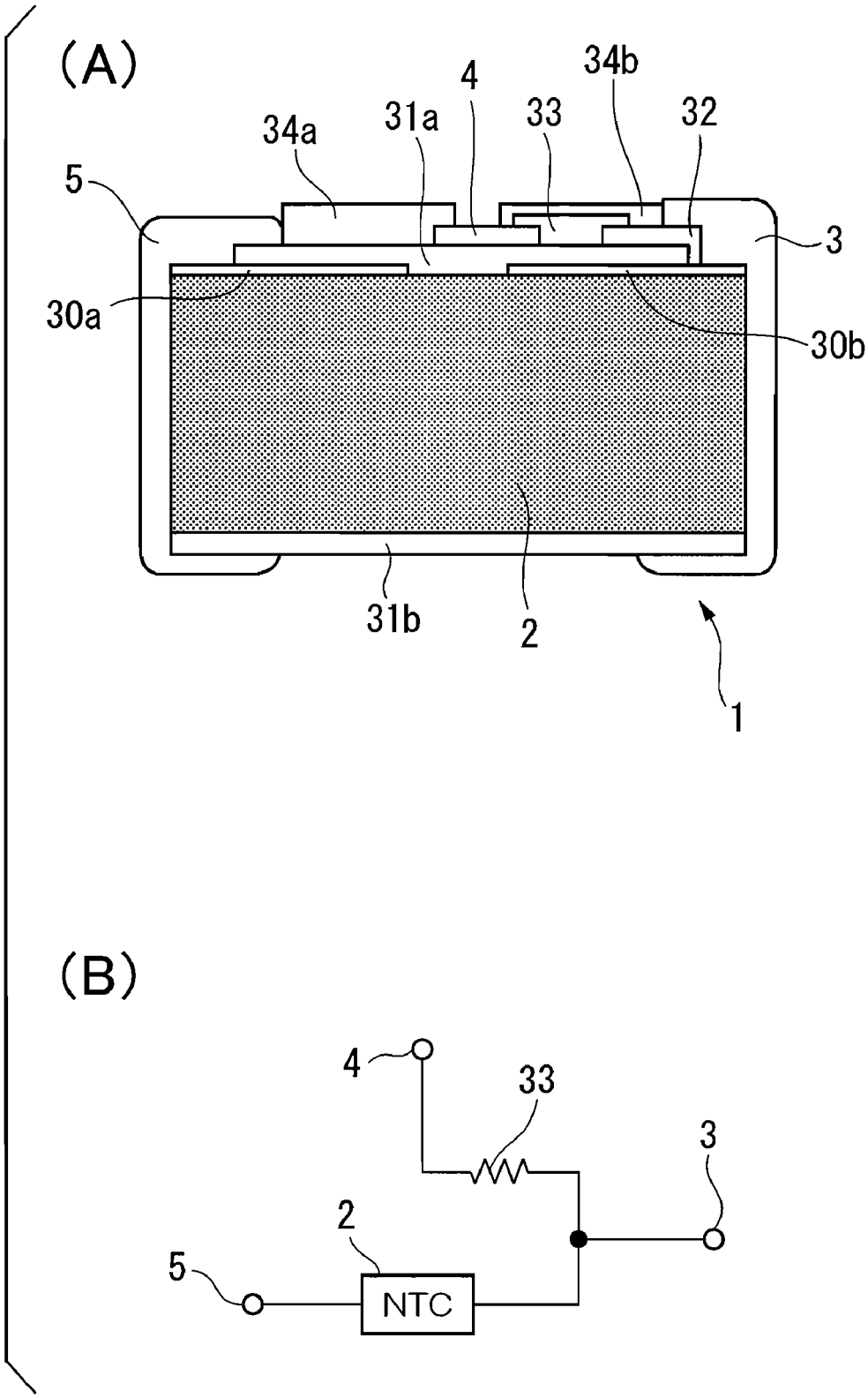
FIG. 15 includes diagrams for illustrating a composite device in accordance with an embodiment of the present invention.

FIG. 15(A) is a cross-sectional view of a composite device 1 in accordance with a further embodiment of the present invention. The composite device 1 includes a chip thermistor element 2, as well as a first terminal electrode 3 and a second terminal electrode 5 formed on both ends of the thermistor element 2.

In this embodiment, the first terminal electrode 3 and the second terminal electrode 5 are formed of a resin electrode plated with Ni and Sn. The first terminal electrode 3 and the second terminal electrode 5 may be realized by other methods such as forming resin electrodes on both ends of the thermistor element 2 via insulating resins or forming baked electrodes.

Surface electrodes 30*a* and 30*b* are formed on the first terminal electrode 3 and the second terminal electrode 5, as well as on a part of the top surface of the thermistor element 2, so as to achieve a better electrical connection from the first terminal electrode 3 and the second terminal electrode 5 to the thermistor element 2. An insulating layer 31*a* for protecting the thermistor element 2 is formed on partial areas of the top surface of the thermistor element 2 and of the surface electrodes 30 (30*a*, 30*b*). Furthermore, an insulating layer 31*b* for protecting the thermistor element 2 is also formed on the bottom surface of the thermistor element 2.

In this embodiment, the composite device 1 is formed using a glass coating for the insulating layers 31 (31*a* and 31*b*). The insulating layers 31 may be formed of a resin coating instead of the glass coating.

A third terminal electrode 4 and a below-the-resistor electrode 32 are formed on a part of the top surface of the insulating layer 31*a*. The below-the-resistor electrode 32 is electrically connected to the first terminal electrode 3 and the surface electrode 30*b*. A resistor layer 33 of a thick film is formed such that an electrical connection is established between the below-the-resistor electrode 30*b* and the third terminal electrode 4. Thereafter, in order to protect the top surface of the composite device 1, insulating layers 34 (34*a*, 34*b*) are formed so as to cover partial areas of the insulating layer 31*a*, the third terminal electrode 4, the below-the-resistor electrode 32, and the resistor layer 33. Finally, the first terminal electrode 3, the second terminal electrode 5, and the third terminal electrode 4 are formed on three side surfaces, respectively, of the main body portion of the composite device 1.

In this embodiment, the composite device 1 is formed using a resin coating for the insulating layers 34. The insulating layers 34 may be formed of a glass coating instead of the resin coating.

This embodiment has been described by way of an example where the insulating layers 34 (34*a*, 34*b*) are formed only on the top surface of the composite device 1; however, the insulating layer 34 may be also formed on the bottom surface of the thermistor element 2 via the insulating layer 31*b* in order to protect the composite device 1.

FIG. 15(B) is an equivalent circuit diagram of the composite device 1 shown in FIG. 15(A). The second terminal electrode 5 is connected to one terminal of the thermistor element 2. In addition, the other terminal of the thermistor element 2 is connected to the first terminal electrode 3, as well as to one terminal of the resistor layer 33. Furthermore, the other terminal of the resistor layer 33 is connected to the third terminal electrode 4.

Figure 16:
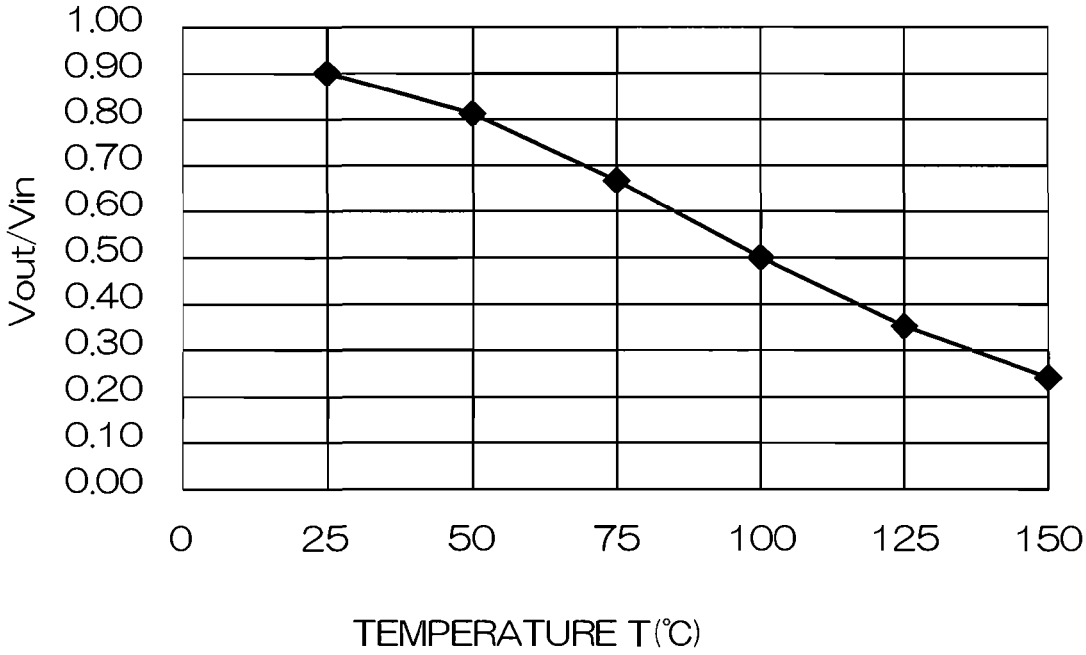
FIG. 16 is a graph showing a characteristic of the composite device in accordance with this embodiment.

FIG. 16 is a graph showing a characteristic in the case where the composite device 1 in accordance with this embodiment is used. In the composite device 1 of FIG. 15(A), when a power supply voltage $V_{in}$ is applied to the third terminal electrode 4 and the second terminal electrode 5 is connected to the ground, a voltage $V_{out}$ output from the first terminal electrode 3 changes in accordance with a temperature T detected by the thermistor element 2. In the graph of FIG. 16, the relationship between T and $V_{out}/V_{in}$ is plotted, where the horizontal axis represents temperature T (degree) and the vertical axis represents $V_{out}/V_{in}$. As the temperature T increases, the value of $V_{out}/V_{in}$ decreases in a substantially linear manner.

In accordance with the composite device 1 of the above-described first to seventh embodiments, a linear "output-voltage to temperature" characteristic is realized in a single chip having three terminals (effective terminals) in voltage output mode. In addition, the composite device 1 with improved temperature-detection accuracy can be provided by matching the characteristic between the thermistor portion and the resistor portion. Furthermore, not only can the composite device 1 itself be made smaller easily and manufactured at low cost, but also the composite device 1 contributing to a reduced total size can be provided without increasing the mounting footprint on the circuit board.

As shown in FIG. 1, the composite device 1 in accordance with all of the embodiments includes a total of three terminals: the first terminal electrode 3, the second terminal electrode 5, and the third terminal electrode 4. However, since the composite device 1 manufactured as shown in FIG. 1 has an electrode (the third terminal electrode 4 of FIG. 2) formed at the center portion only on one side surface, the composite device 1 may not be fixed in a sufficiently firm manner when it is mounted, for example, on a board of an electronic device.

Figure 17:
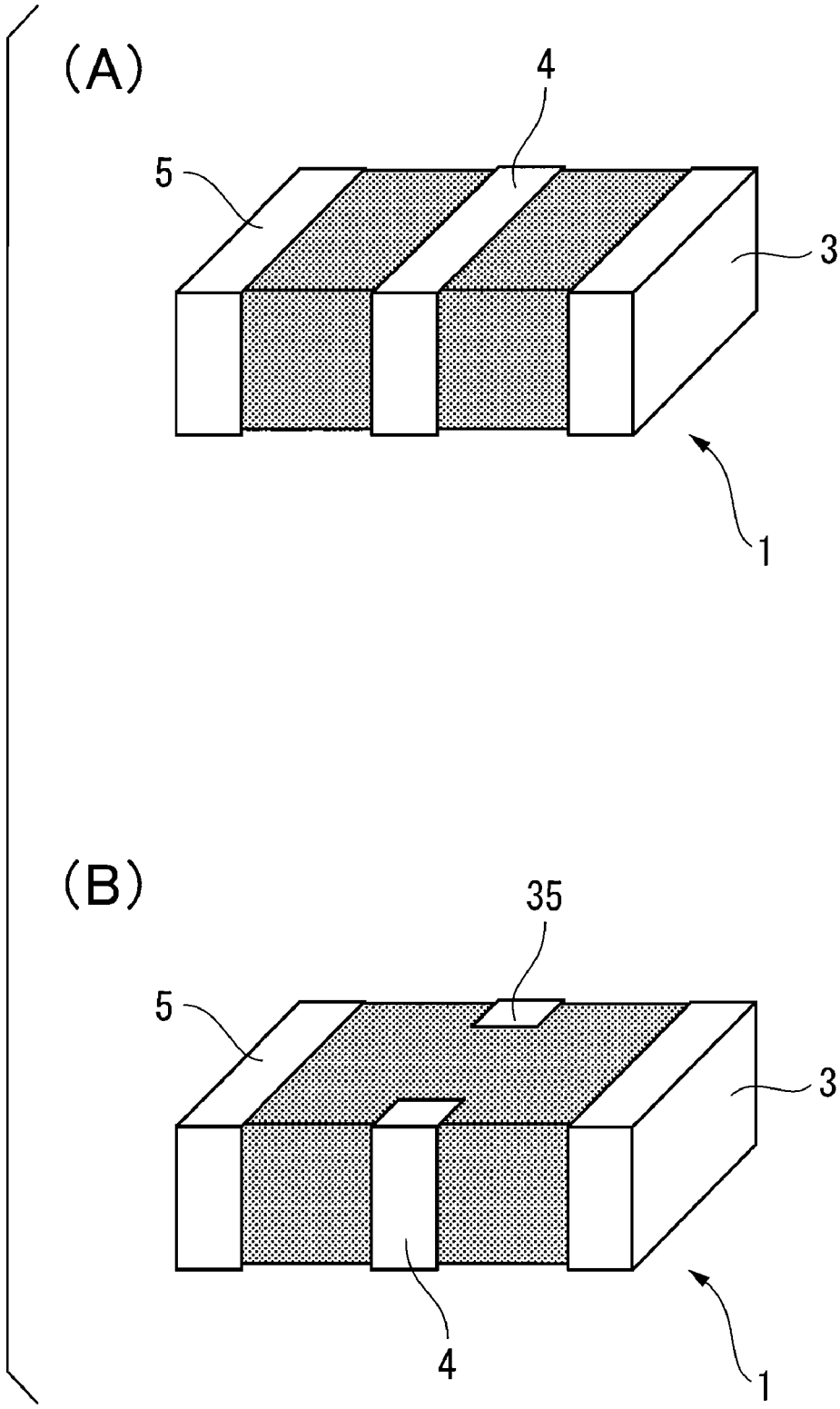
FIG. 17 includes perspective views of one shape of a composite device in accordance with an embodiment of the present invention.

For this reason, as shown in FIG. 17(A), an electrode (third terminal electrode 4) to be formed at the center portion of the composite device 1 may be provided so as to surround the thermistor element 2. By doing so, the composite device 1 can be fixed from both side surfaces of the thermistor element 2 by using the third terminal electrode 4 formed around the thermistor element 2, in addition to the first terminal electrode 3 and the second terminal electrode 5. Therefore, the composite device 1 can be more firmly mounted on a board of, for example, an electronic device.

In addition, as shown in FIG. 17(B), a junction terminal 35 that is electrically insulated from the third terminal electrode 4 may be provided on the opposite side surface to the side surface of the thermistor element 2 on which the third terminal electrode 4 of the composite device 1 is formed. By doing so, since the composite device 1 can be mounted on a board of, for example, an electronic device with a total of four terminals including the first terminal electrode 3, the second terminal electrode 5, the third terminal electrode 4, and the junction terminal 35, the composite device 1 can be mounted more firmly.

Figure 18:
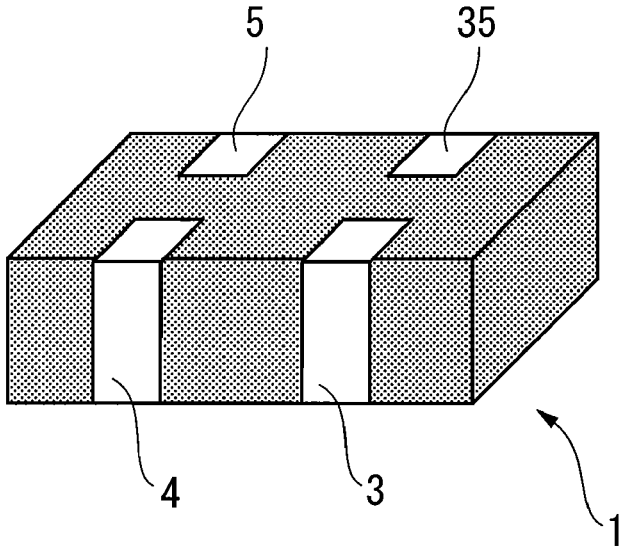
FIG. 18 is a perspective view of another shape of the composite device in accordance with an embodiment of the present invention.
Figure 19:
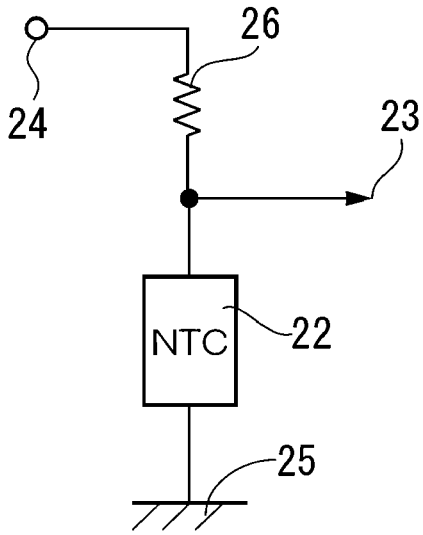
PRIOR ART FIG. 19
FIG. 19 is a diagram for illustrating one example of a known temperature-detection circuit.

In addition, the first terminal electrode 3, the second terminal electrode 5, the third terminal electrode 4, and the junction terminal 35 may be provided on the composite device 1 as shown in FIG. 18. In the composite device 1 shown in FIG. 18, the first terminal electrode 3 and the third terminal electrode 4 are formed on one side surface of the composite device 1, while the second terminal electrode 5 and the junction terminal 35 are formed on the other side surface of the composite device 1. The combination of the four terminals formed on one side surface and the other side surface of the composite device 1 is not limited to that shown in FIG. 18. Instead, any combination of the four terminals is acceptable.

Both side surfaces of the composite device 1 can be more firmly fixed on, for example, a board by providing the composite device 1 with the four terminals (the first terminal electrode 3, the second terminal electrode 5, the third terminal electrode 4, and the junction terminal 35) as described above. Consequently, the composite device 1 can be more firmly mounted.

As described above, the composite device in accordance with the present invention can be effectively used for, for example, a small temperature-detection circuit that can be integrated into a single chip. The present invention has been described with reference to the embodiments; however, the present invention is not limited to those embodiments. As is apparent to those skilled in the art, various modifications, improvements, and combinations are conceivable.

The invention claimed is:

1. A composite device comprising: a first terminal electrode; a second terminal electrode; a third terminal electrode via an insulating layer; and a resistor layer via an insulating layer, which are provided on a surface of a chip thermistor element, wherein the first terminal electrode and the third terminal electrode are connected to the resistor layer, and an internal electrode for adjusting a resistance of the thermistor element is connected to one of or between at least two or more of the first terminal electrode, the second terminal electrode, the third terminal electrode, and the resistor layer.

2. A composite device comprising:

a first terminal electrode; a second terminal electrode; a third terminal electrode via an insulating layer; and a resistor layer via an insulating layer, which are provided on a surface of a chip thermistor element, wherein the first terminal electrode and the third terminal electrode are connected to the resistor layer, and an insulating layer is provided on a surface, except the first to third terminal electrodes, of a main body portion of the composite device, and one or more terminal electrodes which are formed on a side surface of the main body portion and are selected from among the first to third terminal electrodes, are provided on at least one or more side surfaces of the main body portion of the composite device.

3. The composite device according to claim 2, wherein the composite device further comprises a fourth junction terminal in addition to the first to third terminal electrodes, the fourth junction terminal is electrically insulated from the first to third terminal electrodes and is used to fix the composite device, and the fourth terminal electrode is provided on at least one or more side surfaces of the main body portion of the composite device.

4. A composite device comprising: a first terminal electrode; a second terminal electrode and a third terminal electrode via an insulating layer; and a first resistor layer, a second resistor layer, and a third resistor layer via an insulating layer, which are provided on a surface of a chip thermistor element, wherein the first terminal electrode and the third terminal electrode are connected to the first resistor layer, and one end of the first resistor layer is connected to the first terminal electrode and the third resistor layer is connected between the other end of the second resistor layer and the second terminal electrode such that the second resistor layer is connected in parallel to the thermistor element.

5. The composite device according to claim 4, wherein an insulating layer is provided on a surface, except the first to third terminal electrodes, of a main body portion of the composite device, and one or more terminal electrodes which are formed on a side surface of the main body portion and are selected from among the first to third terminal electrodes, are provided on at least one or more side surfaces of the main body portion of the composite device.

6. The composite device according to claim 5, wherein the composite device further comprises a fourth junction terminal in addition to the first to third terminal electrodes, the fourth junction terminal is electrically insulated from the first to third terminal electrodes and is used to fix the composite device, and the fourth terminal electrode is provided on at least one or more side surfaces of the main body portion of the composite device.

7. A composite device comprising: a first terminal electrode; a second terminal electrode; a third terminal electrode; and a resistor layer via an insulating layer, which are provided on a surface of a chip thermistor element wherein the first terminal electrode and the third terminal electrode are connected to the resistor layer, and an internal electrode for adjusting a resistance of the thermistor element is connected to one of or between at least two or more of the first terminal electrode, the second terminal electrode, the third terminal electrode, and the resistor layer.

8. A composite device comprising:

a first terminal electrode; a second terminal electrode; a third terminal electrode; and a resistor layer via an insulating layer, which are provided on a surface of a chip thermistor element, wherein the first terminal electrode and the third terminal electrode are connected to the resistor layer, and an insulating layer is provided on a surface, except the first to third terminal electrodes, of a main body portion of the composite device, and one or more terminal electrodes which are formed on a side surface of the main body portion and are selected from among the first to third terminal electrodes, are provided on at least one or more side surfaces of the main body portion of the composite device.

9. The composite device according to claim 8, wherein the composite device further comprises a fourth junction terminal in addition to the first to third terminal electrodes, the fourth junction terminal is electrically insulated from the first to third terminal electrodes and is used to fix the composite device, and the fourth terminal electrode is provided on at least one or more side surfaces of the main body portion of the composite device.

10. A composite device comprising: a first terminal electrode; a second terminal electrode; a third terminal electrode via an insulating layer; and a first resistor layer and a second resistor layer via an insulating layer, which are provided on a surface of a chip thermistor element, wherein the first terminal electrode and the third terminal electrode are connected to the first resistor layer, and one end of the second resistor layer is connected to the first terminal electrode and the other end is connected to the second terminal electrode such that the second resistor layer is connected in parallel to the thermistor element, and an insulating layer is provided on a surface, except the first to third terminal electrodes, of a main body portion of the composite device, and one or more terminal electrodes which are formed on a side surface of the main body portion and are selected from among the first to third terminal electrodes, are provided on at least one or more side surfaces of the main body portion of the composite device.

11. The composite device according to claim 10, wherein the composite device further comprises a fourth junction terminal in addition to the first to third terminal electrodes, the fourth junction terminal is electrically insulated from the first to third terminal electrodes and is used to fix the composite device, and the fourth terminal electrode is provided on at least one or more side surfaces of the main body portion of the composite device.

* * * * *